US009607602B2

(12) United States Patent
Po et al.

(10) Patent No.: US 9,607,602 B2
(45) Date of Patent: Mar. 28, 2017

(54) ANC SYSTEM WITH SPL-CONTROLLED OUTPUT

(71) Applicant: Apple Inc., Cupertino, CA (US)

(72) Inventors: Bruce C. Po, Foster City, CA (US); Vladan Bajic, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 350 days.

(21) Appl. No.: 14/304,731

(22) Filed: Jun. 13, 2014

(65) Prior Publication Data

US 2015/0071453 A1 Mar. 12, 2015

Related U.S. Application Data

(60) Provisional application No. 61/874,734, filed on Sep. 6, 2013.

(51) Int. Cl.

| | |
|---|---|
| ***G10K 11/16*** | (2006.01) |
| ***G10K 11/175*** | (2006.01) |
| ***G10K 11/178*** | (2006.01) |

(52) U.S. Cl.

CPC ..... *G10K 11/175* (2013.01); *G10K 11/1784* (2013.01); *G10K 2210/1081* (2013.01); *G10K 2210/3056* (2013.01)

(58) Field of Classification Search

CPC ..... H04R 2460/01; H04R 1/1083; H04R 2410/05; G10K 11/175; G10K 2210/108; G10K 2210/1081

USPC ..... 381/71.1, 71.6, 71.11, 71.12, 74

See application file for complete search history.

(56) References Cited

U.S. PATENT DOCUMENTS

| | | | | |
|---|---|---|---|---|
| 7,103,188 | B1 | 9/2006 | Jones | |
| 8,189,799 | B2 | 5/2012 | Shridhar et al. | |
| 8,199,923 | B2 | 6/2012 | Christoph | |
| 8,693,700 | B2 | 4/2014 | Bakalos et al. | |
| 9,230,532 | B1 * | 1/2016 | Lu | H04R 3/005 |
| 2009/0034748 | A1 * | 2/2009 | Sibbald | G10K 11/178 381/71.6 |
| 2010/0098265 | A1 * | 4/2010 | Pan | G10K 11/178 381/94.1 |

(Continued)

FOREIGN PATENT DOCUMENTS

| | | |
|---|---|---|
| GB | 2436657 A | 10/2007 |
| TW | 299062 | 2/1997 |
| TW | 200400487 | 1/2004 |

OTHER PUBLICATIONS

Po, Bruce C. , et al., "TW Office Action", ROC Taiwan Office Action, dated Dec. 8, 2015, Taiwan Patent Application No. 103128855, Filed Aug. 21, 2014, (Dec. 8, 2015).

(Continued)

*Primary Examiner* — Md S Elahee
*Assistant Examiner* — Sabrina Diaz
(74) *Attorney, Agent, or Firm* — Blakely, Sokoloff, Taylor & Zafman LLP

(57) ABSTRACT

An anti-noise signal is produced in accordance with an active noise cancellation process (ANC), at an input of a speaker so as to control how much background noise a user can hear. Strength of the anti-noise signal is adjusted gradually, rather than abruptly, in proportion to decreasing or increasing sound pressure level (SPL) of the background noise, during inactivation or activation of the ANC process. Other embodiments are also described and claimed.

13 Claims, 6 Drawing Sheets

(56) References Cited

U.S. PATENT DOCUMENTS

| | | | |
|---|---|---|---|
| 2010/0272279 | A1 | 10/2010 | Joho et al. |
| 2010/0296668 | A1 | 11/2010 | Lee et al. |
| 2012/0140943 | A1 | 6/2012 | Hendrix et al. |
| 2012/0259626 | A1 | 10/2012 | Li et al. |

OTHER PUBLICATIONS

PCT International Search Report and Written Opinion (dated Feb. 19, 2015), International Application No. PCT/US2014/049492, International Filing Date Aug. 1, 2014, (11 pages).
PCT International Preliminary Report on Patentability (dated Mar. 8, 2016), International Application No. PCT/US2014/049492, International Filing Date Aug. 1, 2014, 7.

* cited by examiner

ANC SYSTEM WITH SPL-CONTROLLED OUTPUT

RELATED MATTERS

This application claims the benefit of the earlier filing date of U.S. Provisional Patent Application No. 61/874,734, filed Sep. 6, 2013.

An embodiment of the invention relates to active noise cancellation (ANC) of unwanted ambient or background sound in a portable electronic, personal listening device. Other embodiments are also described.

BACKGROUND

Active noise cancellation (ANC) is a technique that aims to "cancel" unwanted noise, by introducing an additional, electronically controlled sound field that is also referred to as anti-noise. This technique helps make playback from a media player, or a downlink communications signal in a telephony device, to sound better, or be more intelligible to the listening user. An ANC sub-system may be implemented in a variety of different personal consumer electronic devices such as smartphones, headsets (including wireless headsets), and tablet computers, which are used in environments that are sometimes quiet and sometimes noisy. The anti-noise is electronically manipulated or adjusted to have the proper pressure, amplitude and phase so as to destructively interfere with the ambient or background noise that makes it into the user's ear canal. A residual noise or error remains, which can be picked up by an error sensor, typically an error microphone that is located just in front of the earpiece speaker driver from which the anti-noise is produced.

The use of ANC is expected to be primarily limited to environments that are sufficiently loud, loud enough that the background noise could potentially obstruct the quality or intelligibility of the user content (e.g., music or speech) that is being heard by the user. As such, in environments in which the ambient or background noise is not so loud, ANC may not add significant value and as such it may be turned off. This will help preserve battery life in a portable device, since in many instances the acoustic environment surrounding the user of the portable device is not hostile, i.e. it is relatively quiet, such that running an ANC process provides insignificant user benefits.

SUMMARY

One problem with performing an ANC process is that when turning the ANC sub-system on or off (activation or inactivation), there may be an audible artifact or an audible transition, which can adversely impact the user's experience during a phone call or during digital media playback. For example, the user would likely notice or hear a difference when the ambient background noise level is relatively low but increasing, and ANC is turned on abruptly. This may be due to the ANC sub-system being completely off and then abruptly transitioning to operating at full strength, thereby creating a clearly audible difference during that transition.

In accordance with an embodiment of the invention, the sound pressure level (SPL) of background noise is estimated, and the activation or inactivation of the ANC process is performed gradually, rather than abruptly, based on the estimated background noise SPL. In other words, the strength of ANC is controlled so as to reduce the perceived negative effect of turning on and turning off the ANC process, which will be particularly beneficial in lower ambient noise environments. This may be achieved by controlling the strength or level of the anti-noise, during activation and/or inactivation of the ANC process. The anti-noise signal is varied as a function of the current ambient or background noise SPL, for purposes of either activation or inactivation of the ANC process. Viewed another way, smooth anti-noise control is performed, to avoid a discrete or on/off transition between full strength ANC and lowest strength ANC (or essentially ANC off), wherein the anti-noise level is influenced by the current level of background noise during the transition.

A method for ANC includes estimating the sound pressure level (SPL) of the background or ambient noise, and then activating or inactivating the ANC process gradually, rather than abruptly, based on the estimated background noise SPL. The gradual activation of the ANC process may include varying the strength of the ANC process as a function of the estimated background noise SPL. For example, when the estimated background noise SPL is low, the ANC process produces essentially no anti-noise. As the estimated SPL rises to a medium level, anti-noise starts to be produced with gradually increasing strength. When the estimated SPL becomes high, the anti-noise is produced with greatest strength. The latter corresponds to ANC that is operating at "full strength" which is beneficial in high ambient noise environments.

In one embodiment, the following technique may be used to control (reduce or increase) the anti-noise level, in the context of an adaptive system in which the anti-noise is being produced by an adaptive W filter. In such an ANC system, the filter coefficients of the adaptive W filter are repeatedly updated by an adaptive algorithm or adaptive filter controller, in order to continually strive to reduce the level of the residual noise or ANC error (as picked up by an error microphone). The strength of the anti-noise produced by this process can be varied, by varying how the filter coefficients are updated. For example, consider a leaky adaptive algorithm in which a current coefficient is computed based on weighting a prior coefficient. In this case, the weighting is made variable (rather than fixed), to be a function of the estimated background noise SPL. Without loss of generality, the weighting may be defined as containing a leakage parameter. Whenever the filter coefficients are to be updated (in accordance with a mathematical relationship that uses the leakage parameter), the variable leakage parameter may be updated as a function of the latest, estimated background noise SPL.

The above-described adaptive process results in a gradual activation of the ANC process, starting with a small weighting (or large leakage parameter) when the estimated background SPL is low, and then gradually increasing the weighting (or reducing the leakage parameter) as the background SPL increases. For example, when gradually activating the ANC process, one may start with the smallest weighting (which may be a fixed value) when the background SPL is low, and then gradually increase the weighting as the background SPL rises to medium, and then maintain the largest weighting (which may also be a fixed value) when the background SPL is high. Note that such SPL-based control of the anti-noise output of an ANC process, to achieve gradual turn on and/or turn off of the process, may also work with other adaptive filter-based ANC processes, as well as with non-adaptive ANC processes.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments of the invention with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1:
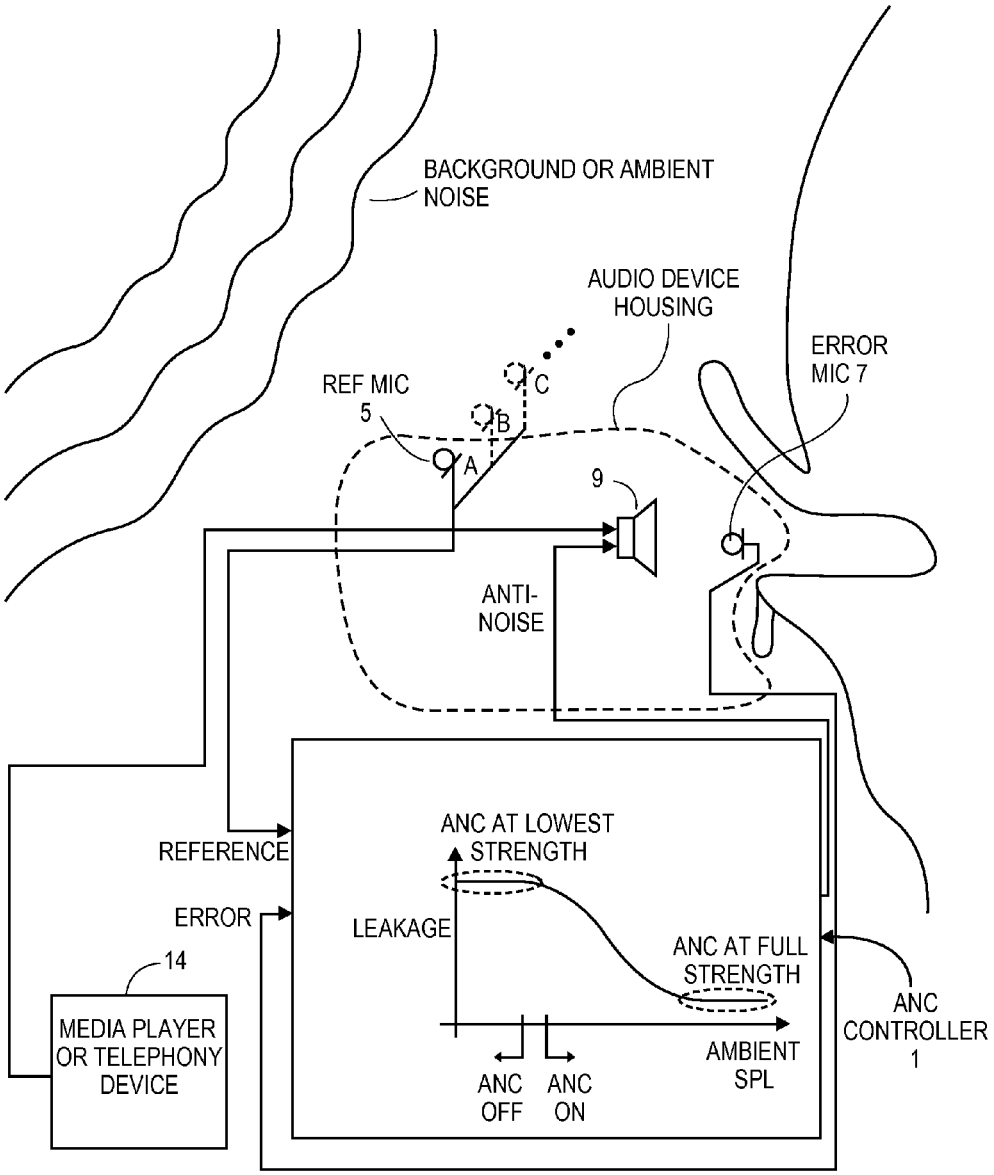
FIG. 1 is a block diagram of relevant parts of a portable electronic device having ANC capability.

Beginning with FIG. 1, an embodiment of the invention is an ANC controller 1 that is implemented in a personal listening system that may include a wired headphone, a smartphone handset, a wireless headset, or other head worn audio device. FIG. 1 is a block diagram of such a consumer electronics device, also referred to here as a portable electronic audio device. The listening system includes a head worn audio device that is "worn" by the user in that its speaker driver 9 is closely positioned next to the user's ear. The speaker driver 9 is a means for converting an audio signal into sound, e.g. an electro-dynamic speaker driver. The speaker driver 9 may be contained within a device housing (e.g., a headphone housing, a smartphone housing) that also includes an error microphone 7 that is located in front of the speaker driver 9 or somewhere in close proximity so as to pick up the sound field close to or in the user's ear canal.

Figure 2:
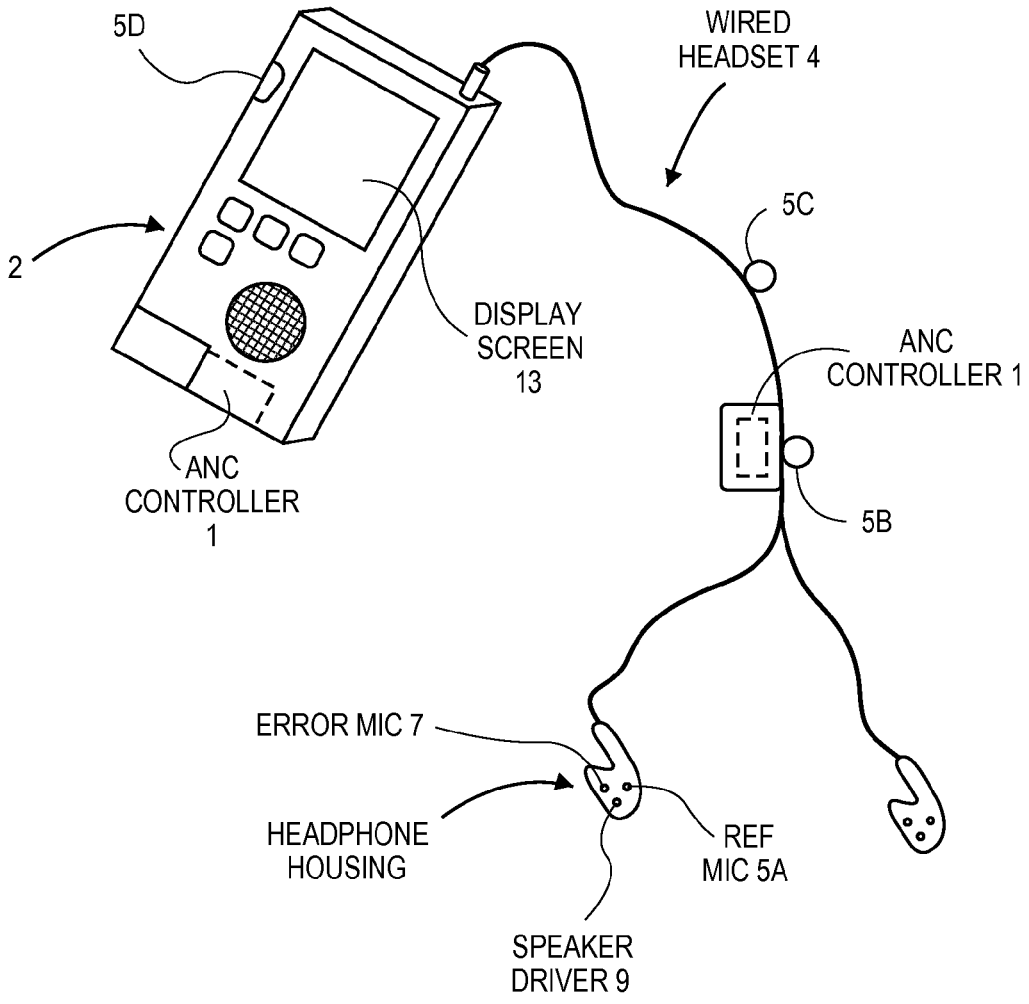
FIG. 2 depicts an example personal listening device in which ANC capability can be implemented.
Figure 3:
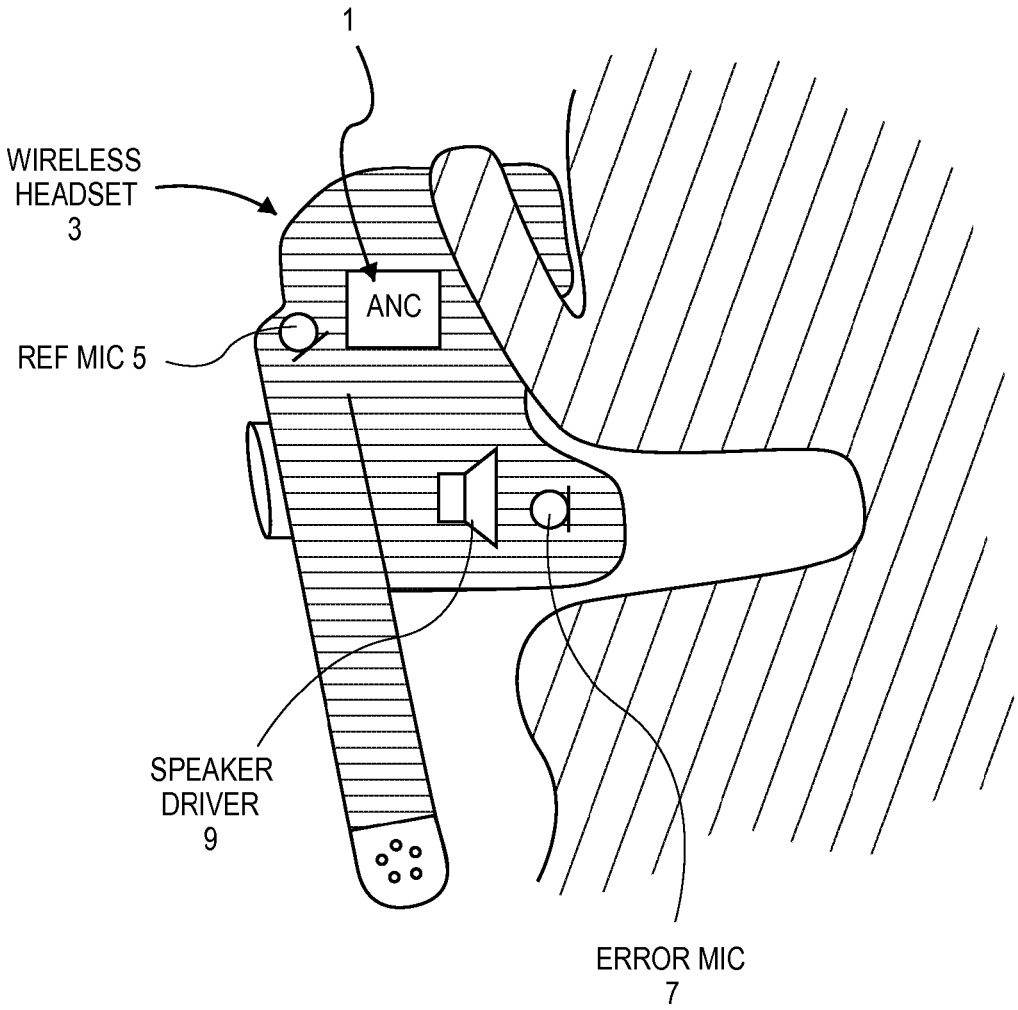
FIG. 3 depicts another personal listening device being a wireless headset.
Figure 4:
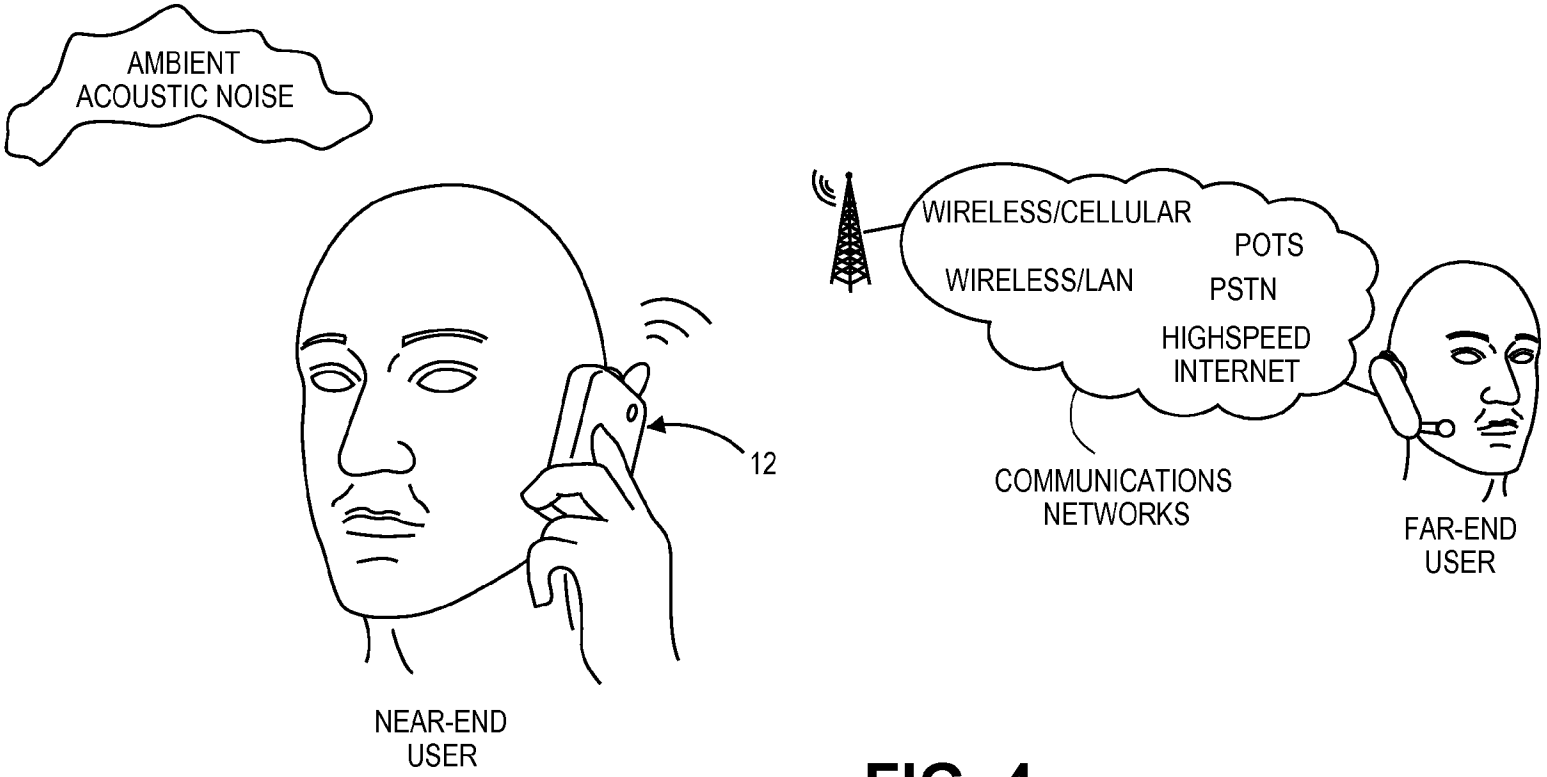
FIG. 4 depicts yet another personal listening device being a smartphone.

The head worn audio device may be a wired headset 4. In that case, the device housing may be that of an earphone or headphone such as a loosely fitting earbud as shown in FIG. 2. As seen in FIG. 2, the headphone may be part of a wired headset 4 that receives both power and an audio content signal from a connected host or source device 2. The latter may be a portable personal multifunction device (e.g., a smartphone, a tablet computer, a compact digital audio player), or it may be a non-portable device such as a home entertainment or an in-vehicle audio/video receiver system. As an alternative to the wired headset 4, the speaker driver 9 and the error microphone 7 may be part of a wireless headset 3 (e.g., a Bluetooth compatible wireless headset) as shown in FIG. 3. As a further alternative, the speaker driver 9 and the error microphone 7 may be in the receiver (earpiece) portion of the housing of a smartphone handset 12, which is "worn" when the receiver portion is held against the user's ear, as shown in FIG. 4. In all of these cases, there is appreciable acoustic leakage past the device housing (headphone or receiver portion) and into the ear of the user of unwanted sound or noise that is in the background or ambient atmosphere surrounding the user. As mentioned earlier, an ANC subsystem may be provided that feeds the speaker driver 9 with an anti-noise signal that may help reduce the amount of background noise that would otherwise corrupt or make less intelligible the user audio content, where the latter may be delivered through a playback or downlink communications signal that is also being fed to the speaker driver 9.

The audio device housing may include a reference microphone 5 that may be located "behind" the speaker driver 9 (in contrast to the error microphone 7 which would be located "in front") as shown, for example, in FIGS. 1-3. There may be one or more of such reference microphones 5 that are positioned or otherwise designed to pickup the background or ambient noise. The ref microphone 5 generates what is referred to here as a reference signal for use by the ANC subsystem. Reference microphones may be positioned on a headset cable as in FIG. 2 (reference microphones 5*b*, 5*c*), where the cable has at one end a headphone housing and at another end a connector or plug, such as a tip ring ring sleeve (TRRS) plug, that mates with a corresponding jack within the host or source device 2. There may also be a further reference microphone 5*d* that is located in the housing of the source device 2, as shown. The error and reference microphones 7, 5 may be acoustic microphones or sound pickup devices. In general, there may be multiple audio pickup devices, including perhaps both acoustic pickup and non-acoustic (vibration) pickup devices, whose signals can be processed and combined into a single reference signal or a single microphone error signal, using, for example, beamforming and/or other audio signal processing.

The signals from the reference microphone 5 and error microphone 7 may be digitized by an analog-to-digital converter (ADC) and then processed by the ANC controller 1. The latter may or may not be integrated within the housing of the host or source device 2—see FIG. 2. The ANC controller 1 may be implemented in the form of hardwired logic circuitry or as a programmed processor that implements digital audio processing operations upon the reference and error microphone signals. It could be implemented inside of an earphone housing of a wired headset 4, or inside a housing of a wireless headset 3 as in FIG. 3. It could alternatively be implemented outside of the earphone housing, for example within a smartphone housing of a smartphone 12—see FIG. 4, or within a case that is attached to an intermediate location along the cable of the wired headset 4—see FIG. 2. Digitized reference and error microphone signals can be routed to the ANC controller 1 through different means, including, for example, via an accessory cable or a headset cable as shown in FIG. 2. The ANC controller 1 together with the ADC circuitry may also be implemented in the form of a programmable processor and support circuitry entirely within the housing of the source device 2—see FIG. 2 and also the smartphone housing in FIG. 4.

Still referring to FIG. 1, the ANC controller 1 produces an anti-noise signal that, in one embodiment, is driven through the same speaker driver 9 that also receives the desired audio content, from a digital media player or telephony device 14. Additional signal processing components (not shown) may be needed to isolate the residual noise or ANC error from the desired audio content (because both would be contained in the error microphone signal from the error microphone 7). The ANC controller 1 operates while the user is for example listening to a digital music file or movie file that is stored in, or is being streamed over a network into, the source device 2 (see FIG. 2). Alternatively, the ANC controller 1 operates while the user is conducting a conversation with a far-end user of a communications network, during an audio phone call or a videophone call (see FIG. 4).

Figure 5:
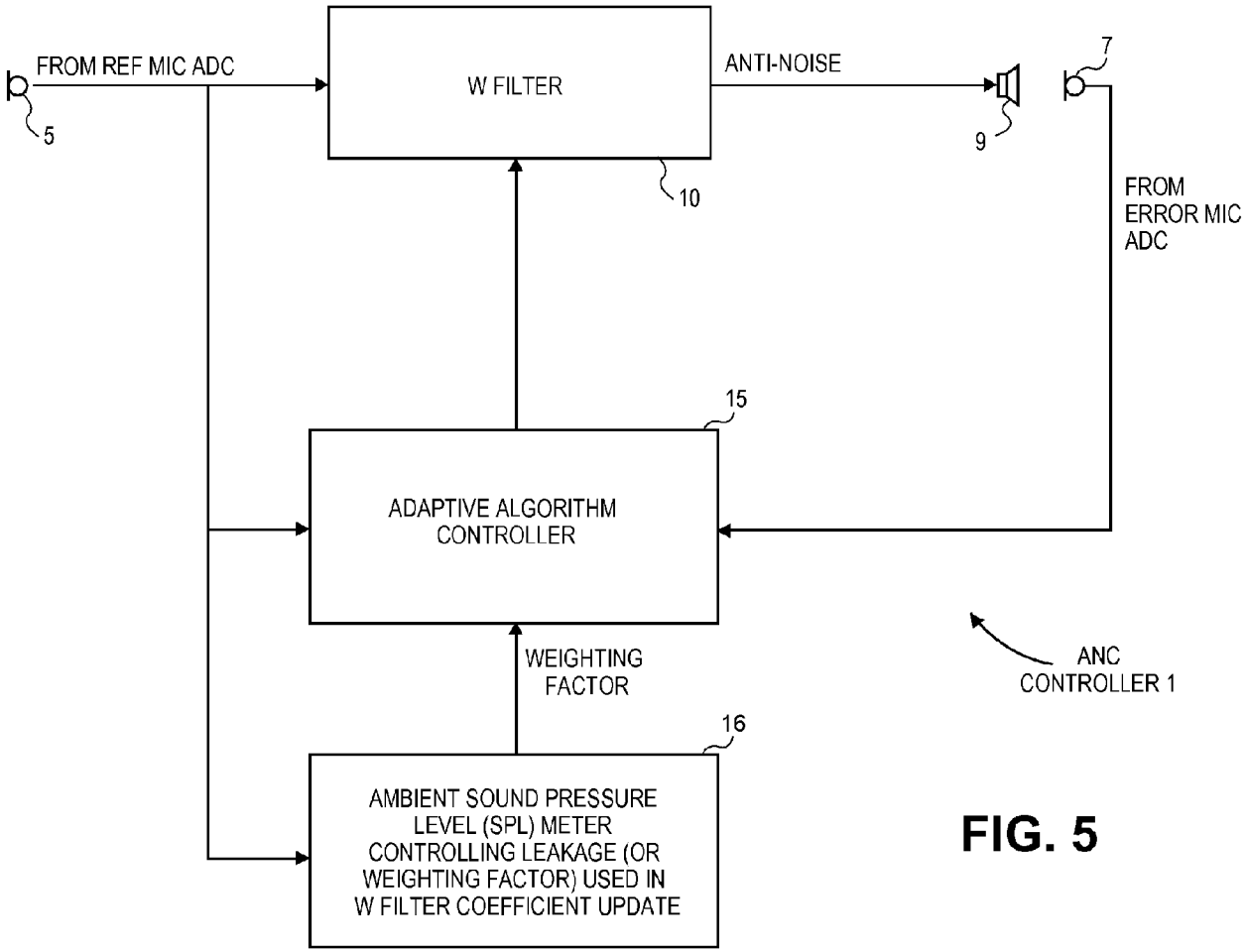
FIG. 5 is a block diagram of relevant parts of an ANC controller.

The ANC controller 1 may implement a conventional feed forward, feed back, or hybrid noise control algorithm. As an example, FIG. 5 depicts an adaptive hybrid system that uses both a reference signal and an error signal from the microphones 5, 7. The controller 1 has an output coupled to the speaker driver 9, and an adaptive W filter 10. The latter is a means for producing an anti-noise signal for input to the speaker driver 9, to be converted by the speaker driver 9 into anti-noise that is designed to limit the amount of the background noise that can be heard by the user.

The controller 1 operates with an acoustic domain having a primary acoustic path for background or ambient noise that leaks past the head worn audio device housing and into the user's ear canal, and a secondary acoustic path for the anti-noise produced by the speaker driver 9—see FIG. 1. The leaked ambient noise and the anti-noise are combined acoustically in the user's ear canal, intentionally in a destructive manner so as to result in a very small residual noise or error, e. The error microphone 7 serves to pickup this residual noise or error, in addition to any user audio content (e.g., a voice or video telephony call or a one-way digital media streaming or playback session) that is being simultaneously converted through the speaker driver 9. In the case of an adaptive ANC sub-system, such as in FIG. 5, the performance of the ANC controller 1 may be monitored by an adaptive algorithm controller 15, which uses the signal from the error microphone 7. The reference microphone 5 may serve to pick up the ambient noise outside of the secondary path (outside the user's ear canal). This reference signal may be used by the adaptive algorithm controller 15, e.g. in accordance with a filtered-x, normalized least mean squares (NLMS) algorithm, to estimate the primary and secondary path transfer functions. The anti-noise signal is produced by the W filter 10. The W filter 10 is an adaptive digital filter whose coefficients are repeatedly or continually being updated by the adaptive algorithm controller 15 so as to drive the error signal, e, to a minimum. Other adaptive filter algorithms can be used, including ones that use different adaptive filter controllers.

When ANC is activated, the adaptive controller 15 performs computations that continually adjust or update the digital filter coefficients of the digital W filter 10, in order to adapt the anti-noise signal to the changing ambient noise and acoustic load seen by the speaker driver 9 while the user is wearing the head worn device. The controller 15 is thus a means for adaptively controlling the W filter 10. During the activation phase, i.e. starting when the adaptive controller 15 is enabled to begin updating the W filter 10, the controller 15 raises strength of the anti-noise signal gradually, rather than abruptly, in proportion to increasing sound pressure level (SPL) of the background noise. In one embodiment of the invention, the ANC controller 1 gradually raises strength of the anti-noise signal by varying how the filter coefficients are updated (by the adaptive controller 15).

As an example of how the filter coefficients can be updated, consider a leaky, least mean squares (LMS) adaptive algorithm in which a current coefficient is computed based on weighting a prior coefficient. According to such an algorithm, the filter coefficients can be updated in accordance with the following example relationship:

$$W(n) \approx \text{alpha} * W(n-1) + \text{mu} * e(n) * x(n)$$

where W(n) is the nth update to the filter coefficients, and W(n−1) is the previous update; e(n) is the nth update to the ANC error or residual noise (which may be derived from the error microphone signal); x(n) is the nth update to the observed background or ambient noise which may be derived from the reference microphone signal; mu, also referred to as step size, is a constant that controls convergence of the adaptive algorithm; and alpha is a weighting fraction (0<alpha<=1) that when decreased serves to increase stability of the algorithm.

Now, in accordance with an embodiment of the invention, the weighting factor alpha is made variable, rather than fixed, during the activation phase and/or the inactivation phase of the adaptive controller 15, and is a function of an estimate of the ambient noise SPL. The variable weighting factor may be pre-determined, for example during laboratory testing, and then stored in the ANC controller 1, as a linear or non-linear function of the ambient noise SPL. Thereafter, during online or in-the-field use of the ANC controller 1, the ambient noise SPL may be estimated or computed by any suitable conventional SPL estimation or measurement technique that uses for example the digitized, reference microphone signal (from the ref microphone 5). The ambient noise SPL estimate may have units of decibels. It may be a single, full audio band value, or it may be a vector of values covering one or more selected audio frequency bins. The stored variable weighting is then determined online (or during in-the-field use) based on this ambient noise SPL estimate, either via a stored table lookup, i.e. stored in the ANC controller 1, or computed via a stored closed form math expression.

Still referring to FIG. 5, an SPL meter and decision logic 16 is provided here that not only estimates the background noise SPL but also uses it to provide an update to the weighting factor (e.g., alpha) that is used (by the adaptive controller 15) in computing updates to the filter coefficients of the W filter 10. The SPL meter and decision logic 16 is a means for varying strength of the anti-noise signal gradually, rather than abruptly, in proportion to decreasing or increasing SPL of the background/ambient noise, during inactivation or activation of the adaptive controller 15.

In one embodiment, the weighting factor alpha (which was introduced above) may be defined as $$\text{alpha} \approx 1 - W_\text{leakage} \text{ where } 0 < W_\text{leakage} < 1$$

The use of a leakage parameter, W_leakage, here is a convenient way of understanding how varying alpha will impact the strength of the anti-noise signal that is being produced by the W filter 10. As such, the variable weighting factor introduced above may be represented by the variable leakage parameter, W_leakage, without loss of generality. Using this representation, increasing the leakage parameter will make the weighting factor smaller and thereby steer the updated coefficients of the W filter 10 towards or closer to zero. This in turn reduces the gain of the W filter 10, which in turn reduces the level of the anti-noise. Thus, in one embodiment, a high leakage is selected to reduce ANC effects in quieter environments, while in louder environments the leakage is made smaller so as to increase the strength of the ANC. The updated leakage parameter can be calculated in real-time or obtained from a stored look up table, referred to in FIG. 6 as a W leakage table whose input is an estimated ambient SPL value (e.g., in dB).

Figure 6:
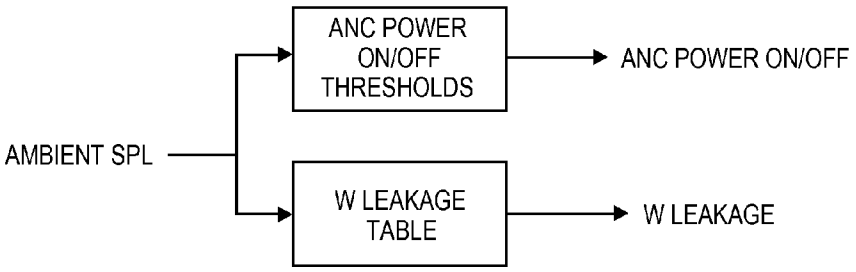
FIG. 6 depicts how ambient SPL can be used simultaneously to control an ANC power on/power off signal and a leakage parameter for ANC digital filter coefficient updates.
Figure 7:
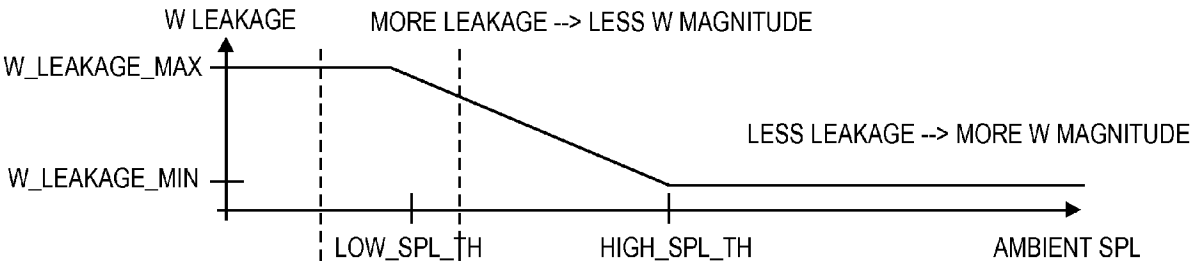
FIG. 7 gives an example, through a waveform, of how a W leakage parameter table can be populated with ambient SPL and W leakage values.

Still referring to FIG. 6, the estimated ambient SPL can be used by the SPL meter and decision logic 16 for purposes of both setting the current leakage parameter, and signaling the adaptive controller 15 (see FIG. 5) to activate or inactivate (referred to here as ANC power on/off). Activation (or ANC power on) may be defined as the point at which the anti-noise signal output from the W filter 10 is enabled (and is then controlled by the adaptive controller 15). Inactivation (or ANC power off) may be defined as the point at which the anti-noise signal output from the W filter 10 is disabled (essentially zero). While the actual signaling of ANC power on/off is considered to be abrupt, as shown in the example activation (right arrow) and inactivation (left arrow) waveforms of FIG. 8, the overall activation and deactivation process itself, in terms of the build-up or decay in the strength of the anti-noise signal, is gradual and may be controlled in accordance with a W leakage function as seen in the example waveform of FIG. 7. FIG. 7 shows as an example a linear variation in the leakage, as a function of ambient SPL, between the low and high SPL thresholds. Recall that more leakage means a smaller weighting factor (alpha in the coefficient update relation given above), which yields less magnitude response (or gain) in the W filter 10, which means a smaller anti-noise signal. Conversely, less leakage means a larger weighting factor, which yields greater magnitude response by the W filter 10, and hence a larger anti-noise signal. Above the high SPL threshold, the leakage is the lowest (and in this case remains fixed), while below the low SPL threshold the leakage is greatest (and in this case also fixed). The region between the low and high SPL thresholds may be deemed a medium ambient SPL region.

Figure 8:
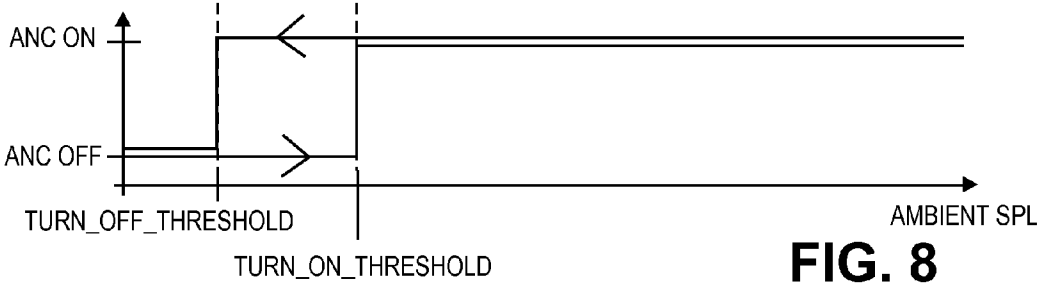
FIG. 8 illustrates, using a waveform, an ANC power on/off control signal vs. ambient SPL and that may be aligned with ambient SPL values in the W leakage table of FIG. 7.

Still referring to FIG. 7 and FIG. 8, in one embodiment, the turn_off and turn_on thresholds of the ANC power on/off control signal are adjusted so that the turn_on threshold is located within a higher leakage region of the sloped, middle leakage section, while the turn_off threshold is located within the highest (and in this example, fixed) leakage section, as shown by the dotted lines linking FIG. 7 and FIG. 8. In this way, during activation, the ANC controller 1 can raise strength of the anti-noise signal gradually, rather than abruptly, in proportion to increasing ambient SPL, between ANC being activated (turn_on_threshold) until ANC is at full strength (FIG. 7, above high_SPL_th). Also, during inactivation, the ANC controller 1 can lower strength of the anti-noise signal gradually, rather than abruptly, in proportion to decreasing ambient SPL, between when ANC is at full strength (FIG. 7, above high_SPL_th) until ANC is inactivated (turn_off_threshold).

Note that the weighting factor alpha introduced above in connection with the coefficient update relationship can be adjusted to prevent unconstrained modes from destabilizing the adaptive algorithm. Typically, however, alpha is fixed to be close to (but smaller than) 1, so as not to diminish the performance of the adaptive algorithm too much. As such, typical use of alpha has been to choose a value that increases stability of the adaptive algorithm, not to make it variable for controlling the strength of the anti-noise so as to yield smoother (less conspicuous to the user) ANC turn on and turn off transitions. In other words, typical uses of the weighting factor (for purposes of stabilizing the adaptive algorithm) do not contemplate reducing the weighting factor to the smallest weighting value W_leakage_min represented in FIG. 7, e.g. corresponding to a leakage parameter being on the order of $2^{-7}$.

An embodiment of the invention is a method for gradually activating ANC, in which sound pressure level (SPL) of background or ambient noise is estimated and is used to directly control how the filter coefficients of an adaptive digital filter, that produces the anti-noise, are updated by an adaptive algorithm. In one embodiment, the gradual activation of the ANC process starts with smallest weighting when the estimated background noise SPL is low (which results in essentially no anti-noise being produced), and then gradually increases the weighting as the estimated background noise SPL is medium, and then maintains a largest weighting when the estimated background noise SPL is high. At high SPL, the adaptive controller and W filter are operating at full strength.

In a similar vein, a method for gradual inactivation of ANC starts with ANC operating at full strength, and then the weighting is gradually decreased as the estimated ambient SPL drops into a medium region, and then maintains a small (or the smallest) weighting when the estimated background noise SPL is low (which results in essentially no anti-noise being produced). The adaptive controller can then be turned off at that point.

An embodiment of the invention may be a machine-readable medium (such as microelectronic memory) having stored thereon instructions, which program one or more data processing components (generically referred to here as a "processor") to perform the digital audio processing operations described above including noise and signal strength measurement, filtering, comparisons, and decision making. In other embodiments, some of these operations might be performed by specific hardware components that contain hardwired logic (e.g., dedicated digital filter blocks). Those operations might alternatively be performed by any combination of programmed data processing components and fixed hardwired circuit components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although the above description uses the example of an ANC engine having a normalized LMS adaptive algorithm, it should be noted that the estimated background noise SPL could also be used to control the output of an ANC engine that is not using that particular adaptive algorithm. The description is thus to be regarded as illustrative instead of limiting.

What is claimed is:

1. A method for active noise cancellation (ANC), comprising:

estimating sound pressure level (SPL) of ambient noise; and one of a) activating an ANC process and b) inactivating the ANC process, gradually, rather than abruptly, based on the estimated ambient noise SPL by varying a strength of the ANC process by updating filter coefficients of an adaptive digital filter of the ANC process in accordance with a leaky adaptive algorithm in which a current coefficient is computed based on weighting a prior coefficient, wherein the weighting is varied as a function of the estimated ambient noise SPL.

2. The method of claim 1 wherein gradually activating the ANC process comprises varying a strength of the ANC process as a function of the estimated ambient noise SPL, so that when the estimated ambient noise SPL is low the ANC process produces essentially no anti-noise and then produces anti-noise with gradually increasing strength when the estimated ambient noise SPL is medium and then produces anti-noise having greatest strength when the estimated ambient noise SPL is high.

3. The method of claim 1 wherein the weighting contains a leakage parameter, and updating the filter coefficients comprises varying the leakage parameter as a function of the estimated ambient noise SPL.

4. The method of claim 1 wherein gradually activating the ANC process comprises starting with a small weighting when the estimated ambient noise SPL is low, and then gradually increasing the weighting as the estimated ambient noise SPL increases.

5. The method of claim 4 wherein gradually activating the ANC process comprises starting with a smallest, fixed weighting when the estimated ambient noise SPL is low, and then gradually increasing the weighting as the estimated ambient noise SPL is medium, and then maintaining a largest, fixed weighting when the estimated ambient noise SPL is high.

6. A portable electronic device comprising:

a speaker; and an active noise cancellation (ANC) controller having an output coupled to the speaker, the ANC controller having an adaptive digital filter that is to produce an anti-noise signal to be converted by the speaker for controlling how much background noise can be heard by a user, wherein the ANC controller raises strength of the anti-noise signal gradually, rather than abruptly, in proportion to increasing sound pressure level of the background noise by updating filter coefficients of the adaptive digital filter that produces the anti-noise signal from ANC being activated until ANC is at full strength, in accordance with a leaky adaptive algorithm in which a current coefficient is computed based on weighting a prior coefficient, wherein the weighting is varied as a function of the sound pressure level of the background noise.

7. The device of claim 6 wherein the ANC controller lowers strength of the anti-noise signal gradually, rather than abruptly, in proportion to decreasing sound pressure level of the background noise between when ANC is at full strength until ANC is inactivated.

8. The device of claim 6 wherein the weighting contains a leakage parameter, and updating the filter coefficients comprises varying the leakage parameter as a function of the sound pressure level of the background noise.

9. The device of claim 6 further comprising an earphone housing or a smartphone handset housing in which the speaker is integrated.

10. A portable electronic device comprising:

a speaker; and an active noise cancellation (ANC) controller having an output coupled to the speaker, the ANC controller having an adaptive digital filter that is to produce an anti-noise signal to be converted by the speaker for controlling how much background noise can be heard by a user, wherein the ANC controller lowers strength of the anti-noise signal gradually, rather than abruptly, in proportion to decreasing sound pressure level of the background noise by updating filter coefficients of the adaptive digital filter that produces the anti-noise signal from when ANC is at full strength until ANC is inactivated, in accordance with a leaky adaptive algorithm in which a current coefficient is computed based on weighting a prior coefficient, wherein the weighting is varied as a function of the sound pressure level of the background noise.

11. The device of claim 10 wherein the weighting contains a leakage parameter, and updating the filter coefficients comprises varying the leakage parameter as a function of the sound pressure level of the background noise.

12. A portable electronic device comprising:

conversion means for converting an audio signal into sound;

anti-noise signal production means for producing an anti-noise signal at an input of the conversion means to control how much background noise can be heard by a user;

adaptive control means for adaptively controlling the anti-noise signal production means;

anti-noise signal strength varying means that includes a) means for raising strength of the anti-noise signal gradually, rather than abruptly, in proportion to increasing sound pressure level of the background noise between the adaptive control means being activated until the adaptive control means is at full strength, and b) means for lowering strength of the anti-noise signal gradually, rather than abruptly, in proportion to decreasing sound pressure level of the background noise between when the adaptive control means is at full strength until the adaptive control means is inactivated; and means for estimating a sound pressure level of the background noise, wherein the anti-noise signal strength varying means causes the adaptive control means to change how it computes updates to digital filter coefficients of the anti-noise signal production means, as a function of the estimated sound pressure level of the background noise;

wherein said means for raising strength and said means for lowering strength cooperatively update the digital filter coefficients of the anti-noise signal production means in accordance with a leaky adaptive algorithm in which a current coefficient is computed based on weighting a prior coefficient, wherein the weighting is varied as a function of the estimated sound pressure level of the background noise.

13. The device of claim 12 wherein said means for raising strength and said means for lowering strength cooperatively cause the anti-noise signal to have a) greatest strength when the estimated sound pressure level of the background noise is high, b) gradually decreasing strength when the estimated sound pressure level of the background noise is medium, c) essentially no strength when the estimated sound pressure level of the background noise is low.

* * * * *